US010558141B2

(12) United States Patent
Kubota et al.

(10) Patent No.: US 10,558,141 B2
(45) Date of Patent: Feb. 11, 2020

(54) IMAGE FORMING APPARATUS, DEVELOPING DEVICE, AND DEVELOPER LIQUID-LEVEL DETECTION PROGRAM

(71) Applicant: Konica Minolta, Inc., Tokyo (JP)

(72) Inventors: Aiko Kubota, Hino (JP); Hiroyuki Saito, Tokyo (JP); Shunichi Takaya, Hino (JP); Kazuteru Ishizuka, Saitama (JP); Kei Okamura, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/204,707

(22) Filed: Nov. 29, 2018

(65) Prior Publication Data

US 2019/0212671 A1 Jul. 11, 2019

(30) Foreign Application Priority Data

Jan. 5, 2018 (JP) ..... 2018-000740

(51) Int. Cl.
*G03G 15/10* (2006.01)
*G03G 15/08* (2006.01)

(52) U.S. Cl.
CPC ..... *G03G 15/0849* (2013.01)

(58) Field of Classification Search
CPC .. G03G 15/10; G03G 15/105; G03G 15/0849; G03G 15/0856; G03G 15/086
USPC ..... 399/38, 53, 57–65, 119, 120, 237, 240
See application file for complete search history.

(56) References Cited

U.S. PATENT DOCUMENTS 6,345,163 B1 * 2/2002 Suzuki ..... G03G 15/0822 399/255
7,561,831 B2 * 7/2009 Naoi ..... G03G 15/0266 399/257
9,046,816 B2 * 6/2015 Ajima ..... G03G 15/556

FOREIGN PATENT DOCUMENTS

JP 2008040227 A 2/2008

* cited by examiner

*Primary Examiner* — Hoan H Tran
(74) *Attorney, Agent, or Firm* — Lucas & Mercanti, LLP

(57) ABSTRACT

An image forming apparatus includes: a developer casing that accommodates a developer; a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector.

16 Claims, 10 Drawing Sheets

IMAGE FORMING APPARATUS, DEVELOPING DEVICE, AND DEVELOPER LIQUID-LEVEL DETECTION PROGRAM

The entire disclosure of Japanese patent Application No. 2018-000740, filed on Jan. 5, 2018, is incorporated herein by reference in its entirety.

BACKGROUND

Technological Field

The present invention relates to an image forming apparatus, a developing device, and a developer liquid-level detection program.

Description of the Related Art

In general, an image forming apparatus (printer, copier, facsimile, and the like) utilizing an electrophotographic process technology, irradiates (exposes) a charged photoconductor drum (image carrier) with a laser beam based on image data, to form an electrostatic latent image. Then, toner is supplied from a developing device to the photoconductor drum on which the electrostatic latent image is formed, whereby the electrostatic latent image is visualized to form a toner image. Furthermore, after the toner image is directly or indirectly transferred onto a sheet, the toner image is fixed by heating and pressurizing at a fixing nip to be formed on the sheet.

A developer detector that detects a liquid level position of the developer is provided in the developing device. For example, in the configuration described in JP 2008-40227 A, each end in the longitudinal direction of the developing device is provided with a developer detector that detects a liquid level position of the developer by detecting the amount of carriers in the developer based on magnetic force. Specifically, the amount of the carriers traversing lines of magnetic force generated from a coil of the developer detector varies in accordance with the liquid level position of the developer. Thus, the liquid level position of the developer is detected by detecting the amount of the carriers.

Furthermore, the developer detector is also capable of detecting toner concentration in the developer by detecting the amount of the carriers in the developer based on the magnetic force. Specifically, for example, in a case where the toner concentration is high, the amount of the carriers traversing the lines of magnetic force from the coil is relatively low. Thus, the toner concentration is detected by detecting variation in such amount of the carriers.

However, for such a developer detector, it is difficult to distinguish the detection result of the liquid level position of the developer from the detection result of the toner concentration. As a result, when one of the detection results varies, there is a possibility that the variation affects the other detection result. For example, in a case where the amount of the carriers detected by the developer detector varies due to variation in the toner concentration in the developer, an output value of the developer detector varies. In particular, in a case where a toner replenisher is provided near the developer detector, the toner concentration varies due to replenishment of the toner. Accordingly, the output value of the developer detector tends to vary.

As a result, even when the liquid level position of the developer is at the same position, the output value of the developer detector varies due to difference in the toner concentration. Thus, there is a possibility that false detection of the liquid level position of the developer occurs.

SUMMARY

An object of the present invention is to provide an image forming apparatus, a developing device, and a developer liquid-level detection program capable of accurately detecting a liquid level position of a developer regardless of toner concentration in the developer, in a developer detector using magnetic force.

To achieve the abovementioned object, according to an aspect of the present invention, an image forming apparatus reflecting one aspect of the present invention comprises: a developer casing that accommodates a developer; a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
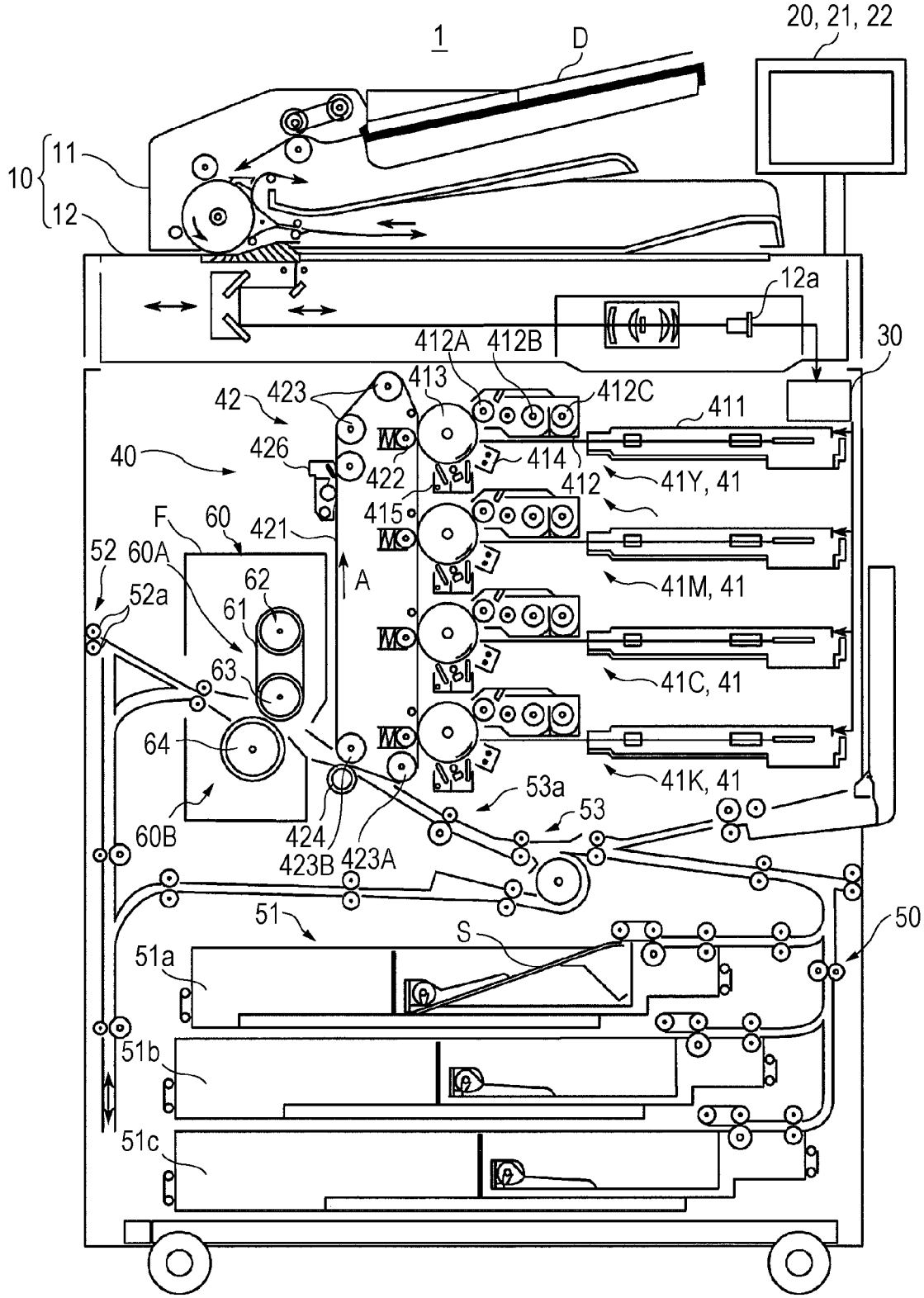
FIG. 1 is a view schematically illustrating the entire configuration of an image forming apparatus according to an embodiment of the present invention.
Figure 2:
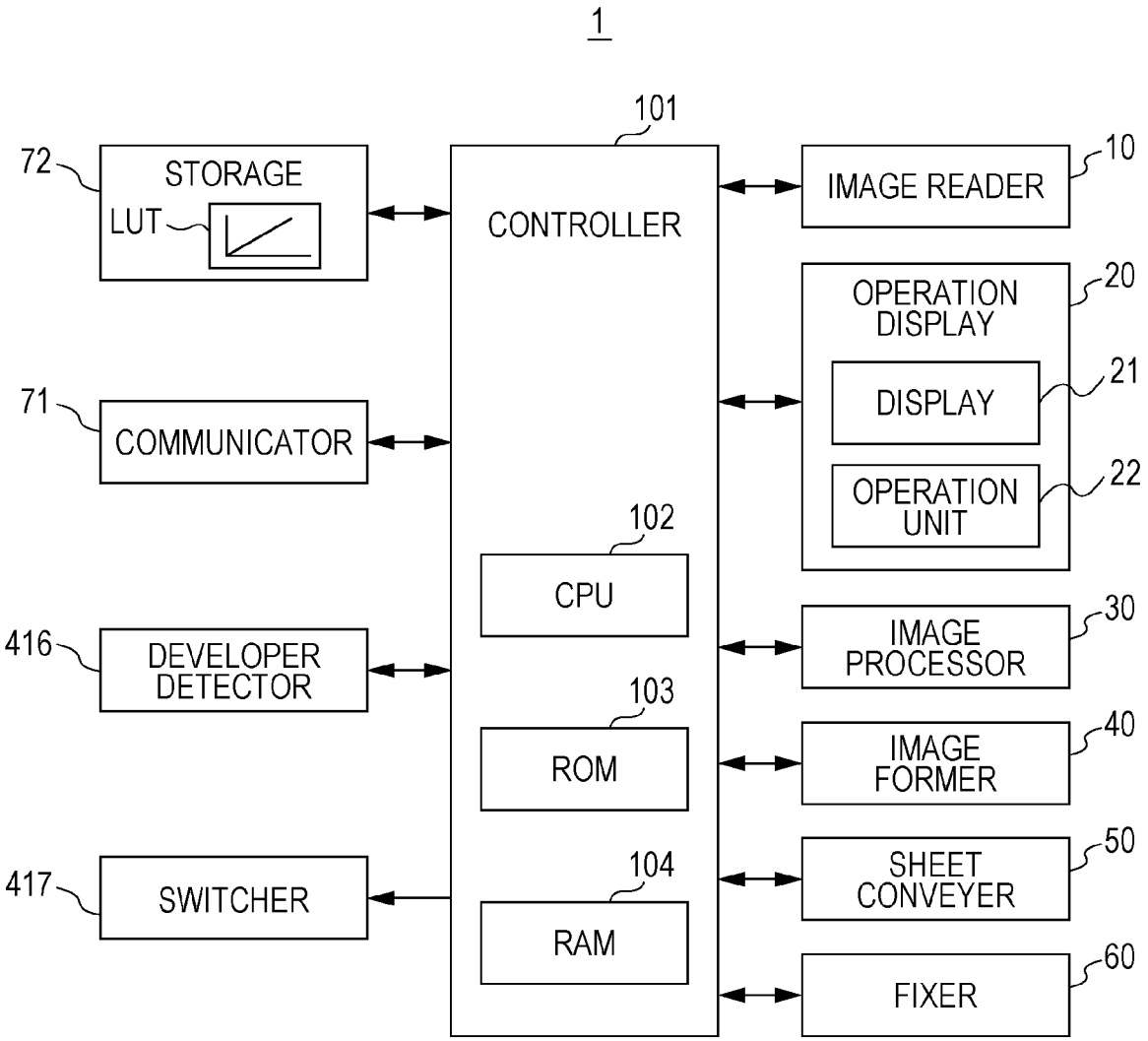
FIG. 2 is a diagram illustrating the main part of a control system of the image forming apparatus according to the present embodiment.

Hereinafter, one or more embodiments of the present invention will be described in detail with reference to the drawings. However, the scope of the invention is not limited to the disclosed embodiments. FIG. 1 is a view schematically illustrating the entire configuration of an image forming apparatus 1 according to the present embodiment. FIG. 2 is a diagram illustrating the main part of a control system of the image forming apparatus 1 according to the present embodiment.

As illustrated in FIG. 1, the image forming apparatus 1 is an intermediate-transfer type color image forming apparatus utilizing an electrophotographic process technology. That is, the image forming apparatus 1 primarily transfers respective toner images of colors of yellow (Y), magenta (M), cyan (C), and black (K) formed on a photoconductor drum 413, onto an intermediate transfer belt 421, and the four color toner images are superimposed on the intermediate transfer belt 421. The superimposed four color toner images are secondarily transferred onto a sheet S sent out from a sheet feeding tray unit 51*a*, 51*b*, or 51*c*, so that an image is formed.

The image forming apparatus 1 adopts a tandem system in which the photoconductor drums 413 each corresponding to the four colors of Y, M, C, and K are disposed in series in the traveling direction of the intermediate transfer belt 421, and the respective toner images of the colors are sequentially transferred onto the intermediate transfer belt 421 in a single procedure.

As illustrated in FIG. 2, the image forming apparatus 1 includes an image reader 10, an operation display 20, an image processor 30, an image former 40, a sheet conveyer 50, a fixer 60, and a controller 101.

The controller 101 includes a central processing unit (CPU) 102, a read only memory (ROM) 103, a random access memory (RAM) 104, and the like. The CPU 102 reads a program corresponding to processing details from the ROM 103 and develops the program in the RAM 104. Then, the CPU 102 cooperates with the developed program to centrally control operation of each block or the like of the image forming apparatus 1. At the time, various data stored in a storage 72 is referred to. The storage 72 includes, for example, a nonvolatile semiconductor memory (so-called flash memory) and a hard disk drive.

The controller 101, via a communicator 71, transmits various data to and receives various data from an external device (for example, a personal computer) connected to a communication network such as a local area network (LAN) and a wide area network (WAN). The controller 101 receives, image data (input image data) transmitted from the external device, and causes an image to be formed on the sheet S based on the image data, for example. The communicator 71 includes a communication control card such as a LAN card.

As illustrated in FIG. 1, the image reader 10 includes an automatic document feeder 11 called an auto document feeder (ADF), a document image scanning device 12 (scanner), and the like.

The automatic document feeder 11 conveys a document D placed on a document tray with a conveyance mechanism to send the document D to the document image scanning device 12. The automatic document feeder 11 is capable of continuously reading images (including both sides) of a large number of documents D placed on the document tray, at once.

The document image scanning device 12 optically scans a document conveyed from the automatic document feeder 11 onto a contact glass or a document placed on the contact glass. Then, the document image scanning device 12 forms, with reflected light from the document, an image on a light-receiving face of a charge coupled device (CCD) sensor 12*a*, to read the document image. The image reader 10 generates input image data based on the reading result by the document image scanning device 12. The input image data is subjected to predetermined image processing in the image processor 30.

As illustrated in FIG. 2, the operation display 20 includes, for example, a liquid crystal display (LCD) with a touch panel, and functions as a display 21 and an operation unit 22. The display 21 displays various operation screens, image states, respective operation states of functions, and the like in response to a display control signal input from the controller 101. The operation unit 22 includes various operation keys such as a numeric key and a start key, accepts various input operations by a user, and outputs an operation signal to the controller 101.

The image processor 30 includes a circuit or the like that performs, on the input image data, digital image processing corresponding to initial setting or user setting. For example, the image processor 30 performs tone correction based on tone correction data (tone correction table), under the control of the controller 101. In addition to the tone correction, the image processor 30 performs, on the input image data, various types of correction processing such as color correction and shading correction, compression processing, and the like. The image former 40 is controlled based on the image data subjected to these types of processing.

As illustrated in FIG. 1, the image former 40 includes image forming units 41Y, 41M, 41C, and 41K, and an intermediate transfer unit 42, and the like. The image forming units 41Y, 41M, 41C, and 41K for forming images with respective color toners of Y component, M component, C component, and K component, based on the input data.

The image forming units 41Y, 41M, 41C, and 41K for the Y component, the M component, the C component, and the K component have respective similar configurations. For convenience of illustration and explanation, the same constituent elements are denoted by the same reference numerals, and when differentiating the constituent elements, Y, M, C, or K is added to the reference numerals. In FIG. 1, only the constituent elements of the image forming unit 41Y for the Y component are denoted by the reference numerals, and the reference numerals of the constituent elements of the other image forming units 41M, 41C, and 41K are omitted.

The image forming unit 41 includes an exposure device 411, a developing device 412, the photoconductor drum 413, a charger 414, a drum cleaner 415, and the like.

The photoconductor drum 413 includes, for example, an organic photosensitive member having a photosensitive layer formed on the outer circumferential face of a drum-shaped metal base. The photosensitive layer includes a resin containing an organic photoconductor.

The controller 101 controls a driving current supplied to a driving motor (not illustrated) that rotates the photoconductor drum 413, so that the controller 101 causes the photoconductor drum 413 to rotate at a constant circumferential speed.

The charger 414 is, for example, an electrification charger, and generates corona discharge to uniformly charge the surface of the photoconductor drum 413 to negative polarity.

The exposure device 411 includes, for example, a semiconductor laser, and irradiates the photoconductor drum 413 with a laser beam corresponding to the respective images of the color components. As a result, due to a potential difference with a background region, an electrostatic latent image of each color component is formed in an image region irradiated with the laser beam on the surface of the photoconductor drum 413.

The developing device 412 is a two-component reversal type developing device, and visualizes the electrostatic latent image by attaching the developer of each color component to the surface of the photoconductor drum 413 and forms a toner image. The developing device 412 includes a developing roller 412A, a first stirring member 412B, a second stirring member 412C, a developer detector 416, and a switcher 417.

The developing roller 412A carries the developer in a developer casing 412D (see FIG. 3), and supplies the developer to the photoconductor drum 413.

Figure 3:
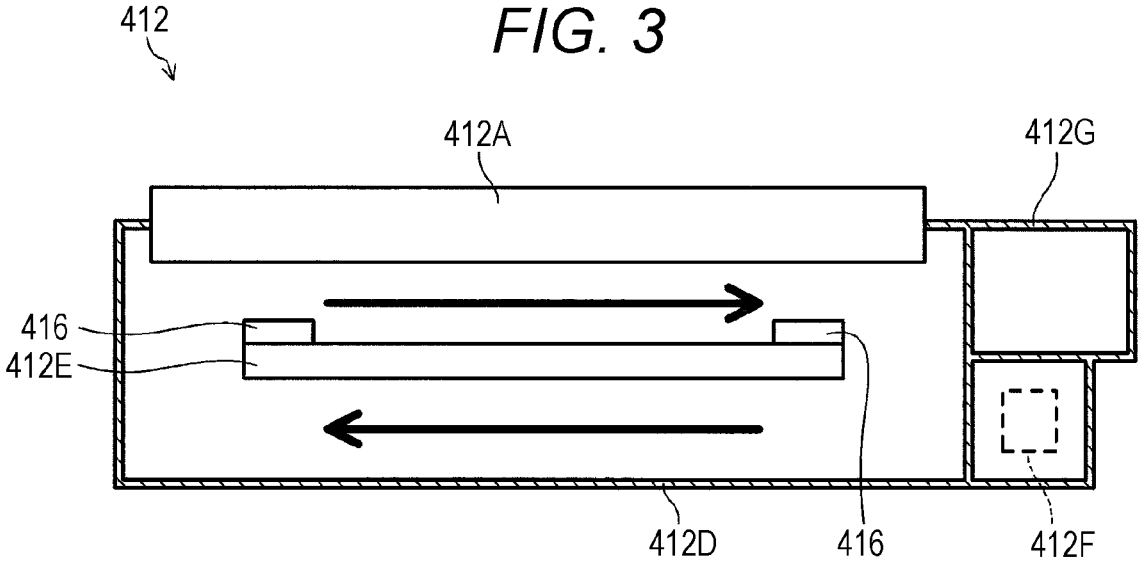
FIG. 3 is a cross-sectional view of a developing device as viewed from above.

Each of the first stirring member 412B and the second stirring member 412C is disposed, as illustrated in FIG. 3, in a region partitioned by a partition 412E provided in the developer casing 412D.

While stirring the developer in the developer casing 412D with rotation, the first stirring member 412B and the second stirring member 412C convey the developer in the developer casing 412D along in a flow of an arrow in the periphery of partition 412E. That is, the first stirring member 412B and the second stirring member 412C convey the developer in the longitudinal direction (left and right direction in FIG. 3) in the developer casing 412D. The first stirring member 412B and the second stirring member 412C each correspond to a "conveyance member" of the present invention.

The developer detector 416 is a so-called magnetic permeability sensor, and detects carriers in the developer based on magnetic force, thereby detecting the liquid level position of the developer in the developer casing 412D. The developer detector 416 is provided on a face on the developing roller 412A side of the partition 412E at each end in the longitudinal direction of the developer casing 412D. Note that the developer detector 416 may be provided in a portion other than the face on the developing roller 412A side of the partition 412E.

The controller 101 performs control of detecting the liquid level position of the developer in the developer casing 412D based on an output value of the developer detector 416. In addition, based on the detection result of the developer detector 416 at each end, inclination correction is performed for the longitudinal direction of the liquid level of the developer with respect to the longitudinal direction of the developer casing 412D.

As illustrated in FIG. 2, the switcher 417 switches a developer detector 416 that detects the developer among a plurality of the developer detectors 416 (to be described later) at respective positions on both of the ends in the longitudinal direction.

Furthermore, as illustrated in FIG. 3, a toner replenisher 412F and a developer discharger 412G are provided at the right end in FIG. 3 of the developer casing 412D. The toner replenisher 412F replenishes toner into the developer casing 412D.

The developer discharger 412G discharges the developer in the developer casing 412D and is provided at the right end in the longitudinal direction of the developer casing 412D. In the developer discharger 412G, a flow of moving the developer from the developer discharger 412G into the developer casing 412D occurs due to rotation of a screw member (not illustrated). As a result, the developer in the developer casing 412D does not enter into the developer discharger 412G.

When the toner is replenished into the developer casing 412D and the amount of the developer exceeds an amount that can be accommodated in the developer casing 412D, the developer moves from the developer casing 412D to the developer discharger 412G to be discharged to a discharge section (not illustrated).

As illustrated in FIG. 1, for example, a direct current (DC) developing bias having the same polarity as the charging polarity of the charger 414 or a developing bias with a DC voltage having the same polarity as the charging polarity of the charger 414 superposed is applied to the developing roller 412A of the developing device 412. As a result, reversal development for attaching the toner to the electrostatic latent image formed by the exposure device 411 is performed.

The drum cleaner 415 is in contact with the surface of the photoconductor drum 413 and has a flat plate-shaped drum cleaning blade or the like including an elastic body. The drum cleaner 415 removes remaining toner that has not been transferred onto the intermediate transfer belt 421, on the surface of the photoconductor drum 413.

The intermediate transfer unit 42 includes the intermediate transfer belt 421, a primary transfer roller 422, a plurality of support rollers 423, a secondary transfer roller 424, a belt cleaner 426, and the like.

The intermediate transfer belt 421 includes an endless belt, and is stretched around the plurality of support rollers 423 in loop. At least one of the plurality of support rollers 423 includes a driving roller, and the others include a driven roller. For example, a roller 423A disposed on the downstream side in the belt traveling direction with respect to the primary transfer roller 422 for the K component may be the driving roller. This makes the traveling speed of the belt at a primary transferor keep constant easily. As the driving roller 423A rotates, the intermediate transfer belt 421 travels at a constant speed in the direction of an arrow A.

The intermediate transfer belt 421 is a belt having conductivity and elasticity, and includes a high resistance layer on the front face. The intermediate transfer belt 421 is rotationally driven by a control signal from the controller 101.

The primary transfer roller 422 is disposed opposed to the respective photoconductor drums 413 of the color components, on the inner circumferential face side of the intermediate transfer belt 421. A primary transfer nip for transferring a toner image from the photoconductor drum 413 onto the intermediate transfer belt 421 is formed by pressing the primary transfer roller 422 against the photoconductor drum 413 via the intermediate transfer belt 421.

The secondary transfer roller 424 is disposed opposed to a backup roller 423B disposed on the downstream side in the belt traveling direction of the driving roller 423A, on the outer circumferential face side of the intermediate transfer belt 421. A secondary transfer nip for transferring the toner image from the intermediate transfer belt 421 onto the sheet S is formed by pressing the secondary transfer roller 424 against the backup roller 423B via the intermediate transfer belt 421.

When the intermediate transfer belt 421 passes through the primary transfer nip, the toner image on the photoconductor drum 413 is sequentially superimposed and primarily transferred onto the intermediate transfer belt 421. Specifically, by applying a primary transfer bias to the primary transfer roller 422, and imparting a charge having a polarity opposite to the polarity of the toner to the back face side of the intermediate transfer belt 421, that is, the side in contact with the primary transfer roller 422, the toner image is electrostatically transferred onto the intermediate transfer belt 421.

Thereafter, when the sheet S passes through the secondary transfer nip, the toner image on the intermediate transfer belt 421 is secondarily transferred onto the sheet S. Specifically, by applying a secondary transfer bias to the secondary transfer roller 424, and imparting a charge having a polarity opposite to the polarity of the toner to the back face side of the sheet S, that is, the side in contact with the secondary transfer roller 424, the toner image is electrostatically transferred onto the sheet S. The sheet S on which the toner image has been transferred is conveyed to the fixer 60.

The belt cleaner 426 removes transfer residual toner remaining on the front face of the intermediate transfer belt 421 after the secondary transfer.

The fixer 60 includes an upper fixer 60A, a lower fixer 60B, and a heating source. The upper fixer 60A includes a fixing-face side member disposed on the fixing face side of the sheet S, that is, the side of the face on which the toner image is formed. The lower fixer 60B includes a back-face side support member disposed on the back face side of the sheet S, that is, the side of the face opposite to the fixing face of the sheet S. By pressing the back-face side support member against the fixing-face side member, a fixing nip that holds and conveys the sheet S is formed.

The fixer 60 heats and pressurizes the sheet S on which the toner image has been secondarily transferred and that has been conveyed, at the fixing nip to fix the toner image on the sheet S. The fixer 60 is disposed as a unit in a fixing device F.

The upper fixer 60A includes an endless fixing belt 61, a heating roller 62, and a fixing roller 63 as fixing-face side members. The fixing belt 61 is stretched around the heating roller 62 and the fixing roller 63.

The lower fixer 60B includes a pressure roller 64 as a back-face side support member. The pressure roller 64 forms a fixing nip that holds and conveys the sheet S between the pressure roller 64 and the fixing belt 61.

The sheet conveyer 50 includes a sheet feeder 51, a sheet discharger 52, a conveyance path 53, and the like. In three sheet feeding tray units 51*a* to 51*c* included in the sheet feeder 51, sheets S (standard paper, special paper) identified based on basis weight, size, and the like are accommodated for each preset type. The conveyance path 53 has a plurality of pairs of conveying rollers including a pair of resist rollers 53*a*. A resist roller unit disposed with the pair of resist rollers 53*a* corrects the oblique and displacement of the sheet S.

The Sheets S accommodated in the sheet feeding tray units 51*a* to 51*c* are sent one by one from an uppermost portion of the sheets S and are conveyed to the image former 40 by the conveyance path 53. In the image former 40, the toner image of the intermediate transfer belt 421 is secondarily transferred onto one side of the sheet S collectively, and a fixing process is performed in the fixer 60. The image formed sheet S is discharged outside the apparatus by the sheet discharger 52 including a sheet discharge roller 52*a*.

Figure 4:
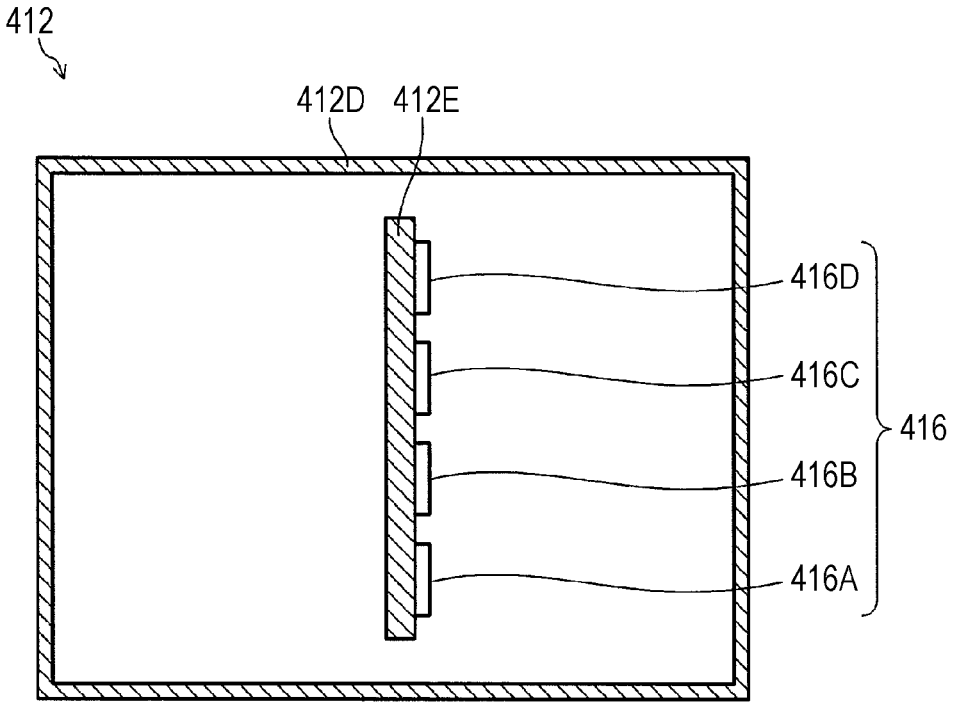
FIG. 4 is a side cross-sectional view of a developer casing.
Figure 5:
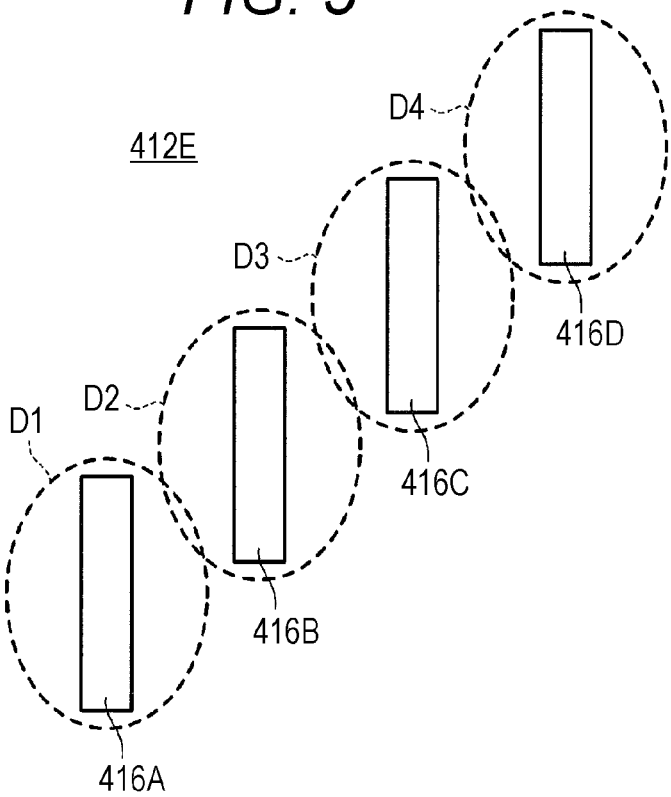
FIG. 5 is a view illustrating the arrangement relationship of developer detectors.

Next, control of detecting the liquid level of the developer in the developer casing 412D will be described. FIG. 4 is a side cross-sectional view of the developer casing 412D. FIG. 5 is a view illustrating the arrangement relationship of the developer detectors 416.

As illustrated in FIG. 4, four developer detectors 416 are disposed close to each other at the respective positions of both of the ends in the longitudinal direction of the developer casing 412D. The four developer detectors 416A, 416B, 416C, and 416D are disposed side by side in the vertical direction so as to be able to detect the developer in the entire range in the vertical direction (up and down direction in FIG. 4), from the maximum liquid level position of the developer in the developer casing 412D.

Note that the four developer detectors 416 at only one end in the longitudinal direction of the developer casing 412D will be described. The other end has a similar configuration to the one end. Thus, the description thereof will be omitted. In the following description, when referring to the developer detector 416, it is assumed that each of the four developer detectors 416A, 416B, 416C, and 416D is indicated.

Specifically, as illustrated in FIG. 5, the four developer detectors 416A, 416B, 416C, and 416D are disposed side by side in the vertical direction and in the horizontal direction. That is, respective detection ranges D1, D2, D3, and D4 of the four developer detectors 416A, 416B, 416C, and 416D are positioned side by side in the vertical direction and in the horizontal direction.

The four developer detectors 416 each are disposed being positioned within a predetermined range in the horizontal direction, by shifting the positions in the horizontal direction, that is, in the longitudinal direction. The predetermined range may be a range that is as short as possible, for example, a range shorter than the range of 30 mm to 40 mm, such that deviation due to the difference in position in the longitudinal direction does not occur for the respective output values of the four developer detectors 416. Note that the horizontal direction may be a direction such as the lateral direction of the developer casing 412D other than the longitudinal direction.

Among the four developer detectors 416, two developer detectors 416 adjacent to each other in the vertical direction are disposed overlapping a part of the two developer detectors 416 in the vertical direction. Specifically, the four developer detectors 416 are disposed having a region in which two detection ranges adjacent to each other in the vertical direction overlap. The four developer detectors 416 output the respective output values to the controller 101 by switching control with the switcher 417 to be described later.

Figure 6:
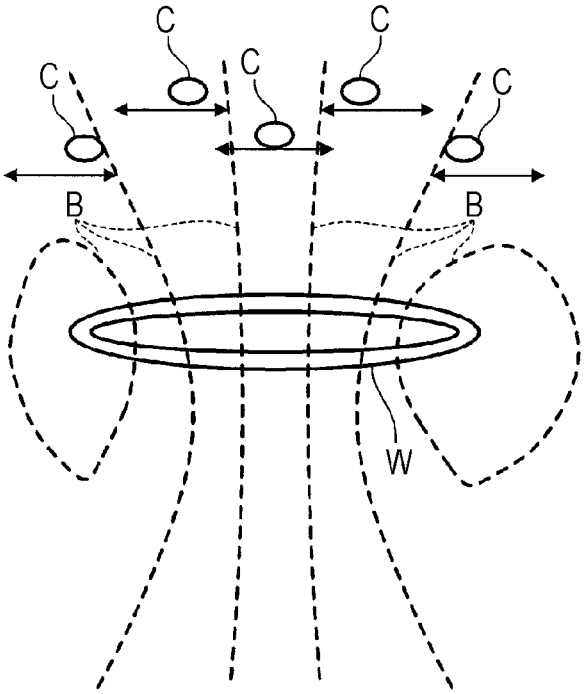
FIG. 6 is a view for explaining developer detection in the developer detector.

The output value of the developer detector 416 is used for detecting the liquid level position of the developer in the developer casing 412D. As illustrated in FIG. 6, the developer detectors 416 each have a coil W. The developer detector 416 is positioned in the developer in the developer casing 412D. Thus, when carriers C as a magnetic material contained in the developer traverse a portion of lines of magnetic force B in the coil W, an induced electromotive force occurs.

Application of voltage across the coil W due to the occurrence of the induced electromotive force, causes the output value of the developer detector 416. Specifically, as the amount of the carriers C traversing the lines of magnetic force B in the coil W increases, the induced electromotive force, that is, the output value of the developer detector 416 increases.

As the ratio of immersion in the developer in the developer casing 412D is large, that is, as the liquid level position of the developer is high, the amount of the carriers C traversing the coil W increases, so that the output value of the developer detector 416 increases.

Figure 7:
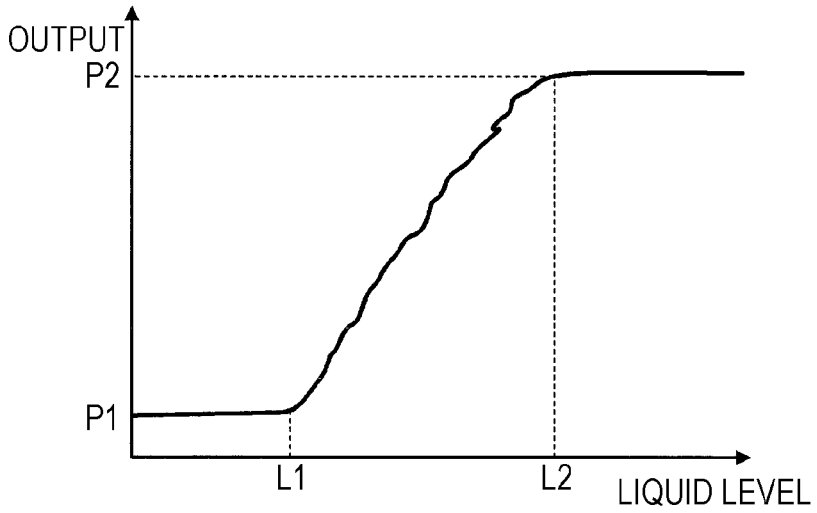
FIG. 7 is a graph indicating a liquid level of the developer with respect to an output of the developer detector at a predetermined position.

The relationship between the output of each developer detector 416 and the liquid level is as illustrated in FIG. 7.

In FIG. 7, L1 on the horizontal axis is a position corresponding to the lower end of the developer detector 416, and L2 on the horizontal axis is a position corresponding to the upper end of the developer detector 416.

When the liquid level of the developer is L1 or less, that is, the lower end of the developer detector 416 or less, the developer detector 416 does not detect the carriers C. Thus, the output value is near P1 that is the minimum output at the developer detector 416. As the liquid level position of the developer is higher than L1, the carriers C detected by the developer detector 416 gradually increases. Thus, the output value of the developer detector 416 increases.

In the present embodiment, the plurality of the developer detectors 416 is disposed side by side in the vertical direction, so that difference occurs in the output values at the respective positions of the developer detectors 416.

Specifically, when the liquid level position of the developer reaches L2 or more, that is, the upper end of the developer detector 416 or more, the developer detector 416 is entirely immersed in the developer. Thus, the output value is near P2 that is the maximum output at the developer detector 416.

Among the four developer detectors 416, the output value of the developer detector 416 positioned at the liquid level position of the developer is an output value between P1 and P2. The positions of the four developer detectors 416 in the vertical direction are different from each other, so that the ratios of immersion in the developer are different from each other. Therefore, among the four developer detectors 416, at least the output value of the developer detector 416 corresponding to the liquid level position of the developer is clearly different from the output values of the other three developer detectors 416. In other words, comparison among the output values of the four developer detectors 416 enables the liquid level of the developer to be detected.

Therefore, the controller 101 detects the liquid level position of the developer in the developer casing 412D, based on the detection results of the four developer detectors 416. The controller 101 acquires the output values of the four developer detectors 416. The controller 101 calculates a difference value between a first output value and a second output value corresponding to two detection ranges adjacent to each other in the vertical direction among the four acquired output values.

The first output value is the output value of the developer detector 416 corresponding to the upper detection range of the two detection ranges. The second output value is the output value of the developer detector 416 corresponding to the lower detection range of the two detection ranges.

Based on the difference value, the controller 101 determines whether or not the first output value is to be used for detecting the liquid level of the developer. In a case where the difference value is larger than a threshold, the controller 101 determines that the liquid level position of the developer is to be detected using the first output value, and detects the liquid level position of the developer based on the first output value. A method of detecting the liquid level position of the developer will be described later.

The threshold is appropriately set in accordance with the degree of overlapping of the two developer detectors 416 adjacent to each other in the vertical direction, and is set at, for example, 10%. The difference value between the first output value and the second output value may be a difference value based on an actual output value of the developer detector 416 or a difference value based on a value converted into the liquid level position.

With this arrangement, the developer detector 416 corresponding to the liquid level position of the developer can be accurately selected. Thus, the liquid level position of the developer can be easily detected.

When determining that the first output value is to be used for detecting the liquid level position of the developer, the controller 101 detects the toner concentration in the developer in the developer casing 412D, based on the second output value.

The toner concentration in the developer can be detected from the output value of the developer detector 416. The developer detector 416 detects the amount of the carriers C with respect to the volume of a portion of the developer detector 416 immersed in the developer. Thus, the amount of the carriers C varies in accordance with the toner concentration of the portion.

That is, in the portion, in a case where the amount of toner is large, the amount of the carriers C traversing the lines of magnetic force B of the coil W decreases. Therefore, in the relationship between the toner concentration and the output of the developer detector 416, as the toner concentration increases, the output value of the developer detector 416 decreases.

However, for the developer detector 416 corresponding to the liquid level position of the developer, the amount of the carriers C detected varies depending on the ratio of immersion in the developer. Thus, the toner concentration is difficult to be accurately detected.

Therefore, in the present embodiment, the toner concentration is detected using the second output value of the developer detector 416 that is positioned one level below the developer detector 416 that detects the liquid level position of the developer. With this arrangement, the developer detector 416 with entirely immersed in the developer or with a large ratio of immersion in the developer can detect the toner concentration. As a result, more accurate toner concentration can be detected.

In addition, distinguishment can be clearly made between the toner concentration detection and the developer liquid-level position detection by the developer detector 416 using the magnetic force. The developer detector 416 to be used for detecting the toner concentration may be the developer detector 416 positioned below the developer detector 416 corresponding to the first output value. However, from the viewpoint of improving the reliability of the detected value of the liquid level position and the detected value of the toner concentration, the second output value may be the output value of the developer detector 416 that is within a closer range and positioned one level below the developer detector 416 corresponding to the first output value.

Furthermore, in a case where the output value of the developer detector 416A at the bottom position among the four developer detectors 416 is a predetermined threshold (for example, 5%) or less, the controller 101 determines either an excessive state of the toner concentration or an insufficient state of the amount of the developer. The case where the output value of the developer detector 416A is low is considered to be a case where the liquid level position of the developer is low and toner replenishment is required or where the toner concentration in the developer is excessive.

Therefore, in a case where the output value of the developer detector 416A at the bottom position is the predetermined threshold or less, the controller 101 increases an input voltage of the developer detector 416A by, for example, 50%. Accordingly, in a case where the output value of the developer detector 416A has increased by, for example, 10%, the controller 101 determines the excessive state of the toner concentration, and performs control of recovering the toner concentration.

The case that the output value of the developer detector 416A has increased with the increase in the input voltage means that there is a sufficient amount of the developer near the developer detector 416A, that is, it is considered that there is a certain amount of the carriers. Thus, in such a case, the controller 101 determines the excessive state of the toner concentration, and recovers the toner concentration.

Examples of the control of recovering the toner concentration include, for example, control of replenishing carriers, and control of outputting an alarm such as display of causing a user to pay attention to replenishing of carriers.

Furthermore, in a case where the controller 101 increases the input voltage of the developer detector 416A by, for example, 50% and then the output value of the developer detector 416A has not increase by, for example, 10%, the controller 101 determines the insufficient state of the amount of the developer, and performs control of replenishing toner.

The case that the output value of the developer detector 416A has not increased with the increase in the input voltage means that there is not a sufficient amount of the developer near the developer detector 416A, that is, there is not a certain amount of the carriers. Therefore, in such a case, the controller 101 determines the insufficient state of the amount of the developer, and performs the control of replenishing the toner.

Furthermore, although the control of recovering the toner concentration or the control of replenishing the toner has been performed a predetermined number of times (for example, seven times) or more, in a case where the output value of the developer detector 416A is the predetermined threshold or less, the controller 101 performs control of outputting an alarm.

The fact that the output value of the developer detector 416A is still low although the control of recovering the toner concentration or the control of replenishing the toner has been repeated several times, means that some malfunction occurs in the apparatus. Thus, the user can be positively encouraged to pay attention by outputting an alarm.

The control of outputting the alarm may be any control that can notify the user of occurrence of some malfunction in the apparatus, for example, control of causing the display 21 to display an alarm and control of generating sound.

Next, a method of detecting the liquid level position of the developer will be described.

In the present embodiment, as described above, the liquid level position of the developer is detected by using one developer detector 416 among the four developer detectors 416. However, the output value of the developer detector 416 varies depending on the amount of the carriers C traversing the lines of magnetic force B of the coil W. Therefore, although the liquid level position of the developer is the same, the output value of the developer detector 416 varies due to difference in the toner concentration.

Specifically, in a case where the toner concentration has a value lower than a target value (for example, 5 to 6%), the developer detector 416 outputs a value lower than a value equivalent to the actual height at the liquid level position of the developer. Furthermore, in a case where the toner concentration has a value higher than the target value, the developer detector 416 outputs a value higher than the value equivalent to the actual height at the liquid level position of the developer.

Therefore, in accordance with calculated toner concentration, the controller 101 corrects a reference value that is the detected value of the liquid level position of the developer detected based on the first output value.

Figure 8:
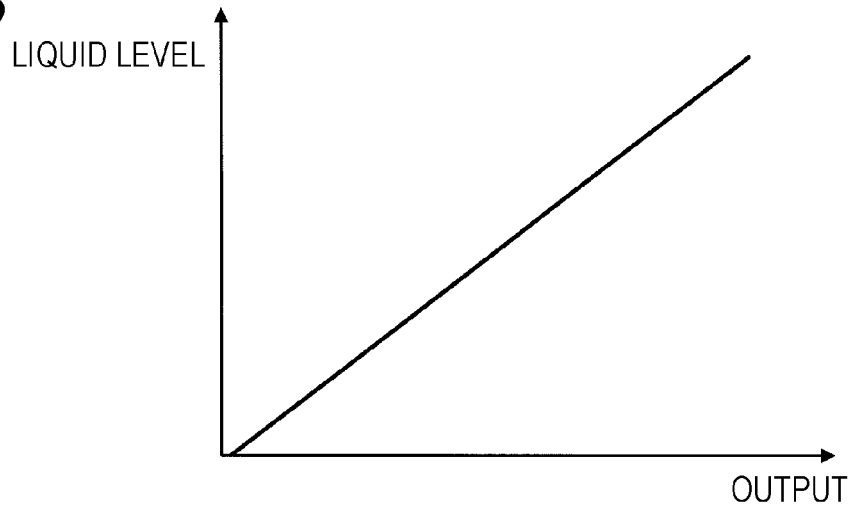
FIG. 8 is a graph indicating the relationship between the output and the liquid level of the developer in the developer detector.

For example, as illustrated in FIG. 8, from the relationship between the output value of the developer detector 416 and the liquid level position of the developer when the toner concentration is the target value, the controller 101 calculates the reference value of the liquid level position of the developer. The relationship between the output value of the developer detector 416 and the liquid level position of the developer is a linear function in which the output value of the developer detector 416 increases as the liquid level position of the developer rises, and is stored in advance in the storage 72, for example.

Figure 9:
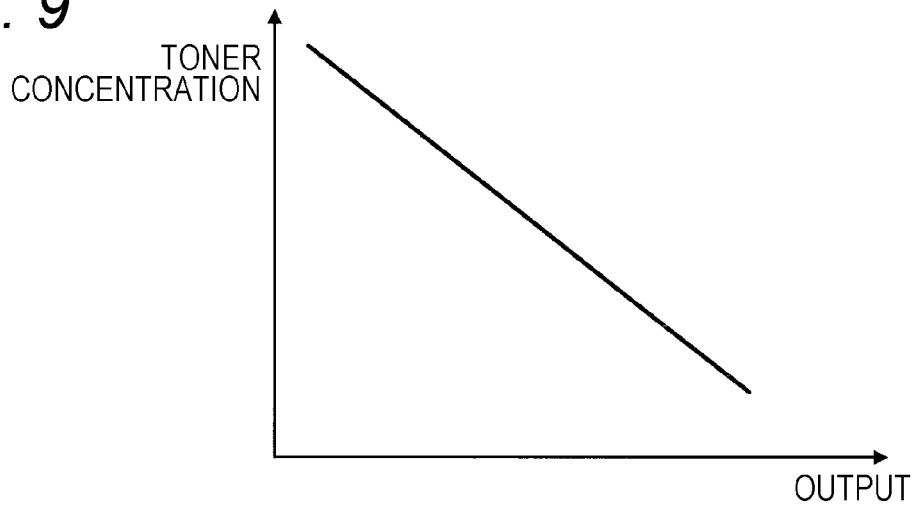
FIG. 9 is a graph indicating the relationship between the output and toner concentration in the developer detector.

For example, as illustrated in FIG. 9, the controller 101 calculates the toner concentration from the relationship between the output value of the developer detector 416 with entirely immersed in the developer and the toner concentration. The relationship between the output value of the developer detector 416 and the toner concentration is a linear function in which the output value of the developer detector 416 decreases as the toner concentration decreases, and is stored in advance in the storage 72, for example.

The controller 101 calculates the liquid level position of the developer by multiplying the reference value of the liquid level position of the developer by an amount of correction corresponding to the toner concentration. For example, as indicated in Table 1, the amount of correction is set for each toner concentration.

TABLE 1

| Toner concentration (%) | Correction amount |
|---|---|
| 3 to 4% | 1.3 |
| 4 to 5% | 1.2 |
| 5 to 6% | 1 |
| 6 to 7% | 0.9 |

In Table 1, with an amount of correction of 1 based on a toner concentration of 5 to 6% that is a target value, the amount of correction is set so as to increase as the toner concentration decreases below the target value, and the amount of correction is set so as to decrease as the toner concentration exceeds the target value.

With this setting, the liquid level position of the developer can be detected in consideration of the variation of the toner concentration, so that the liquid level position of the developer can be accurately detected.

Next, the inclination correction for the longitudinal direction of the liquid level position of the developer with respect to the longitudinal direction of the developer casing 412D will be described.

Since the developer detectors 416 are disposed at both of the ends in the longitudinal direction of the developer casing 412D, the liquid level position of the developer at each end is detected. However, when the liquid level position of the developer inclines in the longitudinal direction, an image defect (unevenness due to screw) in which marks by the stirring member appear on an image occurs at the end on the side where the liquid level position is low. Furthermore, when the liquid level position becomes higher on the side where the developer discharger 412G is positioned, clogging of the developer occurs at a portion of the developer discharger 412G.

In the present embodiment, the inclination correction for the liquid level position of the developer is performed by comparing the liquid level positions of the developer at the respective ends. Specifically, the controller 101 calculates a difference value between the liquid level positions of the developer at the respective ends, and in accordance with the calculated difference value, performs control of correcting the inclination of the liquid level position of the developer in the longitudinal direction.

The control of correcting the inclination of the liquid level position of the developer is, for example, control of adjusting the rotational speeds of the first stirring member 412B and the second stirring member 412C. For example, when the liquid level position of the developer on the left side (hereinafter, referred to as left liquid-level position) is higher than the liquid level position of the developer on the right side (hereinafter, referred to as right liquid-level position), the rotational speed of the stirring member in the upper region with respect to the partition 412E is increased. With this arrangement, the moving speed of the developer to the right side becomes fast. Thus, the movement amount of the developer increases from the side where the liquid level position is higher, that is, from the side where the amount of the developer is large, so that the liquid level position of the developer tends to be horizontal in the longitudinal direction.

In a case where the left liquid-level position is lower than the right liquid-level position, the rotational speed of the stirring member in the upper region with respect to the partition 412E is decreased. With this arrangement, the moving speed of the developer to the right side becomes slow. Thus, the movement amount of the developer decreases from the side where the liquid level position is lower, that is, from the side where the amount of the developer is small, so that the liquid level position of the developer tends to be horizontal in the longitudinal direction.

For example, the amount of correction for the rotational speed is set for each difference value between the left liquid-level position and the right liquid-level position as indicated in Table 2, for example.

TABLE 2

| Difference value A | Correction amount |
|---|---|
| A ≥ 10 mm | 1.2 |
| 3 mm < A ≤ 10 mm | 1.1 |
| −3 mm ≤ A ≤ 3 mm | 1 |
| −10 mm ≤ A < −3 mm | 0.9 |
| A ≤ −10 mm | 0.8 |

In Table 2, the amount of correction is set so as to increase the rotational speed from the reference value (within the range of −3 mm to 3 mm) when the difference value is larger than 3 mm, and the amount of correction is set so as to further increase the rotational speed when the difference value is 10 mm or more. Furthermore, the amount of correction is set so as to decrease the rotational speed from the reference value when the difference value is less than −3 mm, and the amount of correction is set so as to further decrease the rotational speed from the reference value when the difference value is −10 mm or less.

Note that, for the stirring member in the lower region with respect to the partition 412E, the control of adjusting the rotational speed may be performed in the same manner as the stirring member in the upper region in accordance with the inclination of the liquid level. Furthermore, only the rotational speed may be controlled for either the stirring member in the upper region or the stirring member in the lower region.

Next, the switching control with switcher 417 will be described.

As illustrated in FIG. 5, the four developer detectors 416 are disposed such that the two developer detectors 416 adjacent to each other in the vertical direction overlap mutually. When a region in which these detection ranges overlap mutually is not provided, in a case where the liquid level of the developer is positioned in a region between the two developer detectors 416, the detection accuracy of the liquid level of the developer is reduced.

However, in such disposition, the two adjacent detection ranges also have a mutually overlapping region. The developer detector 416 detects the amount of the carriers using the magnetic force. Thus, the lines of magnetic force in the detection ranges interfere with each other, so that there is a possibility that a desired output value at the developer detector 416 is not obtained.

Therefore, the controller 101 performs the switching control with the switcher 417, thereby making the detection timing of each developer detector 416 different. Specifically, the controller 101 controls the switcher 417 such that the detection timings of two adjacent detection ranges do not coincide.

For example, the control may be performed so as to sequentially detect the developer detectors 416 in order from the bottom. Alternatively, the control may also be performed so as to simultaneously detect the bottom developer detector 416A and the second developer detector 416C from the top, and then simultaneously detect the second developer detector 416B from the bottom and the top developer detector 416D.

With this arrangement, the interference of the lines of magnetic force in the detection ranges with each other can be suppressed.

Figure 10:
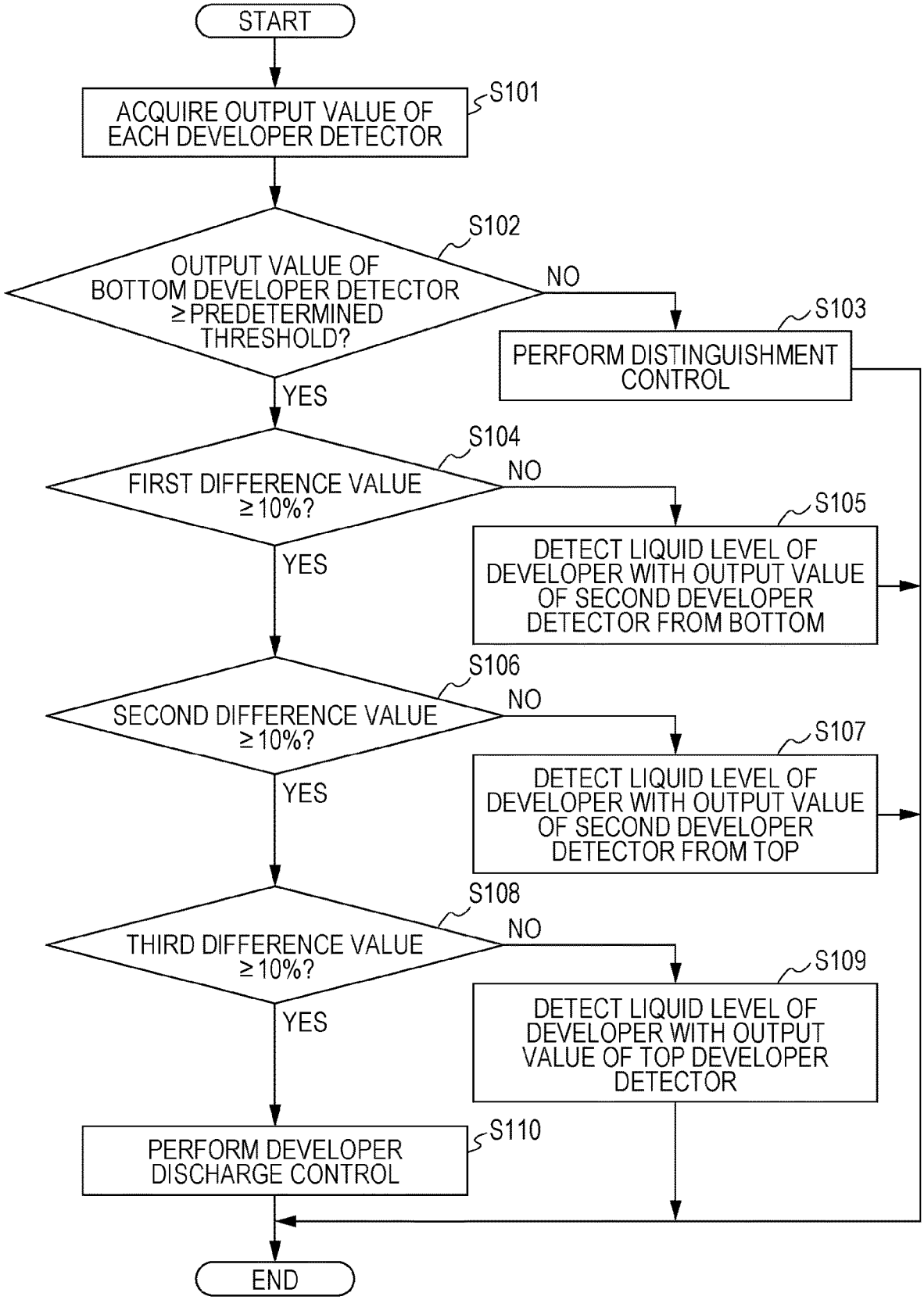
FIG. 10 is a flowchart illustrating an operation example when control of detecting the liquid level of the developer is performed in the image forming apparatus.

Next, an operation example when control of detecting the liquid level of the developer is performed in the image forming apparatus 1 will be described. FIG. 10 is a flowchart illustrating the operation example when the control of detecting the liquid level of the developer is performed in the image forming apparatus 1. The processing in FIG. 10 is performed when the controller 101 receives an execution command of print processing.

As illustrated in FIG. 10, the controller 101 acquires the output value of each developer detector 416 (step S101). Next, the controller 101 determines whether or not the output value of the bottom developer detector 416A is a predetermined threshold or more (step S102).

As a result of the determination, in a case where the output value is less than the predetermined threshold (NO in step S102), the controller 101 performs control of distinguishing the excessive state of the toner concentration from the insufficient state of the amount of the developer (step S103). Details of the control of distinguishing will be described later.

On the other hand, in a case where the output value is the predetermined threshold or more (YES in step S102), the controller 101 determines whether or not a first difference value between the output value of the bottom developer detector 416A and the output value of the second developer detector 416B from the bottom is 10% or more (step S104).

As a result of the determination, in a case where the first difference value is less than 10% (NO in step S104), the controller 101 detects the liquid level position of the developer with the output value of the second developer detector 416B from the bottom (step S105).

On the other hand, in a case where the first difference value is 10% or more (YES in step S104), the controller 101 determines whether or not a second difference value between the output value of the second developer detector 416B from the bottom and the output value of the second developer detector 416C from the top is 10% or more (step S106).

As a result of the determination, in a case where the second difference value is less than 10% (NO in step S106), the controller 101 detects the liquid level position of the developer with the output value of the second developer detector 416C from the top (step S107).

On the other hand, in a case where the second difference value is 10% or more (YES in step S106), the controller 101 determines whether or not a third difference value between the output value of the second developer detector 416C from the top and the output value of the top developer detector 416D is 10% or more (step S108).

As a result of the determination, in a case where the third difference value is less than 10% (NO in step S108), the controller 101 detects the liquid level position of the developer with the output value of the top developer detector 416D (step S109).

On the other hand, in a case where the third difference value is 10% or more (YES in step S108), the controller 101 performs control of discharging the developer with the developer discharger 412G (step S110). The control of discharging the developer is control for positively moving the developer in the developer casing 412D into the developer discharger 412G by, for example, replenishing toner.

After step S103, step S105, step S107, step S109, and step S110 are performed, the present control ends. Note that the processing in step S101 may be repeated after the end of the present control.

Figure 11:
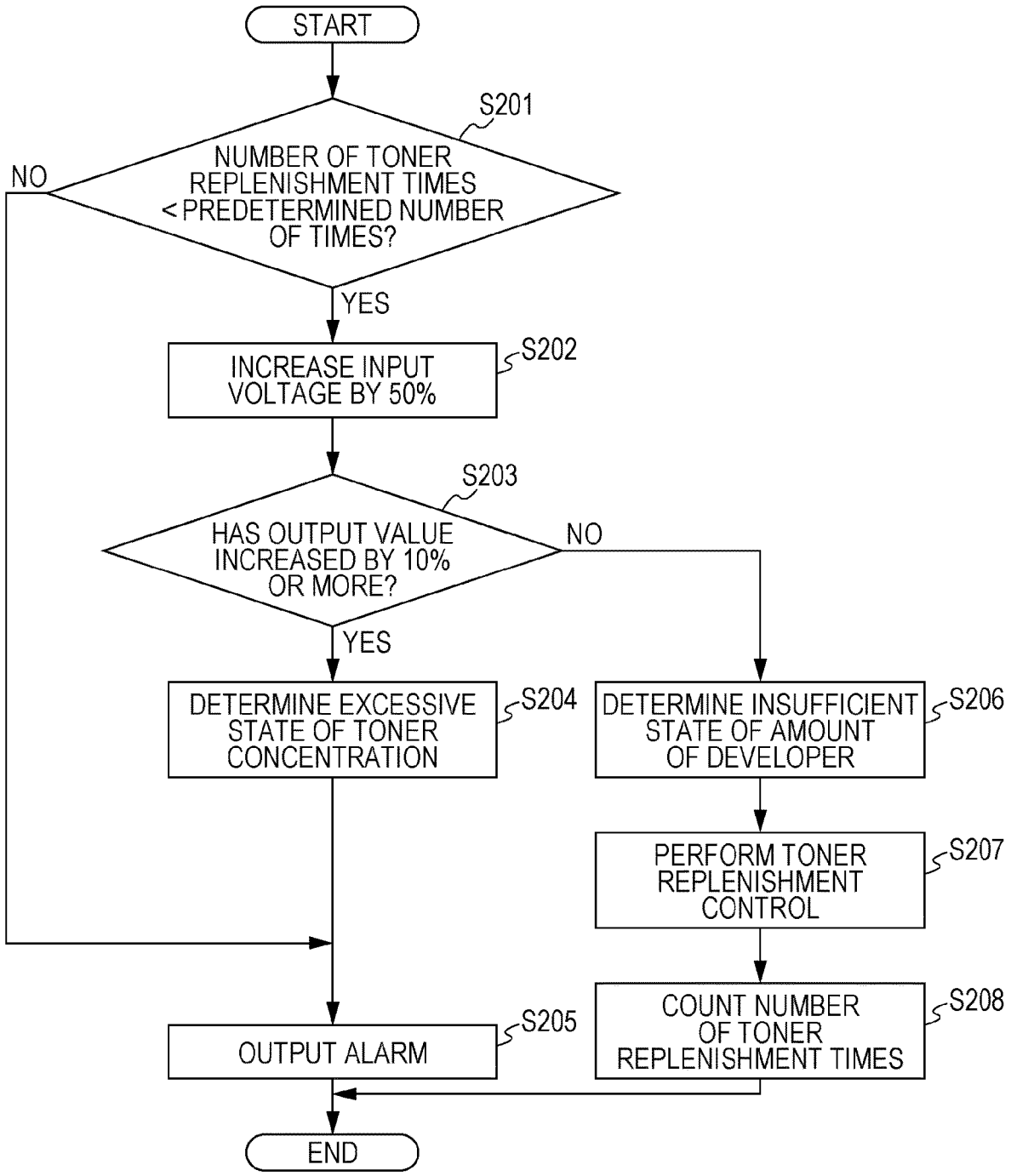
FIG. 11 is a flowchart illustrating an operation example when control of distinguishing is performed in the image forming apparatus.

Next, an operation example when control of distinguishing is performed in the image forming apparatus 1 will be described. FIG. 11 is a flowchart illustrating the operation example when the control of distinguishing is performed in the image forming apparatus 1. The processing in FIG. 11 is performed when the controller 101 receives the processing in step S103 in FIG. 10.

As illustrated in FIG. 11, the controller 101 determines whether or not the number of toner replenishment times is less than the predetermined number of times (step S201). The number of toner replenishment times indicates the number of times that the control of replenishing the toner has been performed in step S207 to be described later, and is stored in the storage 72.

As a result of the determination, in a case where the number of toner replenishment times is the predetermined number of times or more (NO in step S201), the processing proceeds to step S205. On the other hand, in a case where the number of toner replenishment times is less than the predetermined number of times (YES in step S201), the input voltage of the bottom developer detector 416A is increased by 50% (step S202).

Next, the controller 101 determines whether or not the output value of the developer detector 416A has increased by 10% or more (step S203). As a result of the determination, in a case where the output value has increased by 10% or more (YES in step S203), the controller 101 determines the excessive state of the toner concentration (step S204). Next, the controller 101 performs control of outputting an alarm (step S205). Note that, control of replenishing carriers may be performed after step S204 is performed.

Returning to the determination in step S203, in a case where the output value has not increased by 10% or more (NO in step S203), the controller 101 determines the insufficient state of the amount of the developer (step S206). Next, the controller 101 performs control of replenishing the toner (step S207).

Next, the controller 101 counts the number of toner replenishment times and stores the result in the storage 72 (step S208). Note that the number of toner replenishment times may be reset, for example, in a case where the controller 101 determines YES in the processing in step S102 in FIG. 10.

According to the present embodiment as described above, the four developer detectors 416 detect the liquid level position of the developer with the output value of the developer detector 416 corresponding to the liquid level position of the developer. Thus, the liquid level position of the developer can be detected more accurately. As a result, the detection accuracy of the liquid level position of the developer can be improved by using the output value.

In addition, the toner concentration is detected with the output value of the developer detector 416 one level below the developer detector 416 that has detected the liquid level position of the developer, that is, with the output value of the developer detector 416 with immersed in the developer. Thus, the toner concentration can be detected more accurately. Furthermore, since the developer detector 416 that has detected the liquid level position of the developer and the developer detector 416 at the closer position are used, the detection accuracy of the toner concentration can be improved.

Furthermore, the liquid level position of the developer is corrected in accordance with the variation of the toner concentration. Thus, the output variation of the developer detector 416 due to the variation of the toner concentration is canceled, and the detection accuracy of the liquid level position of the developer can be further improved. Furthermore, the distinguishment between the toner concentration detection and the detection of the liquid level position of the developer can be accurately performed.

Furthermore, the inclination in the longitudinal direction of the liquid level of the developer with respect to the longitudinal direction of the developer casing 412D can be corrected. Thus, the occurrence in the image defect due to the inclination in the longitudinal direction of the liquid level of the developer can be reduced.

Furthermore, the developer detectors 416 may be disposed such that the detection range D4 of the developer detector 416D at the top position includes the highest position where the developer can be accommodated in the developer casing 412D. With this arrangement, even when the liquid level of the developer reaches a position where clogging of the developer occurs in the developer discharger 412G, the developer detector 416D at the top position can detect the liquid level position of the developer.

Figure 12:
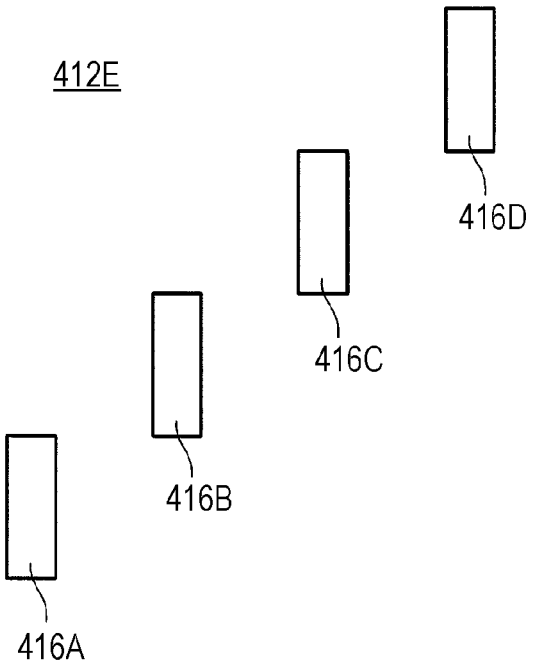
FIG. 12 is a view illustrating another example of the arrangement relationship of the developer detectors.

In the above-described embodiment, the two adjacent developer detectors 416 among the plurality of the developer detectors 416 are disposed overlapping mutually in the vertical direction. However, the present invention is not limited thereto, and the two adjacent developer detectors 416 may not overlap mutually in the vertical direction. For example, as illustrated in FIG. 12, the lower end of the upper developer detector 416 and the upper end of the lower developer detector 416 of the two adjacent developer detectors 416 may have the same position in the vertical direction.

Figure 13:
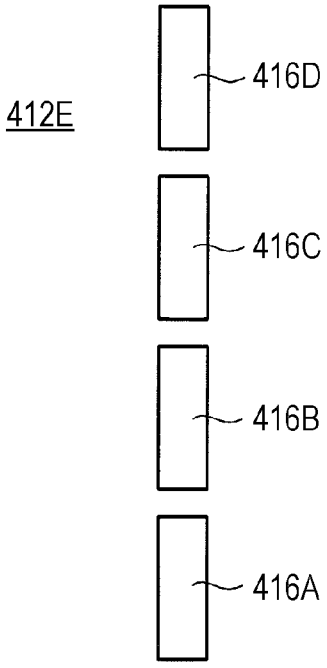
FIG. 13 is a view illustrating yet another example of the arrangement relationship of the developer detectors.

Furthermore, as illustrated in FIG. 13, the lower end of the upper developer detector 416 and the upper end of the lower developer detector 416 may be separated from each other is the vertical direction.

Figure 14:
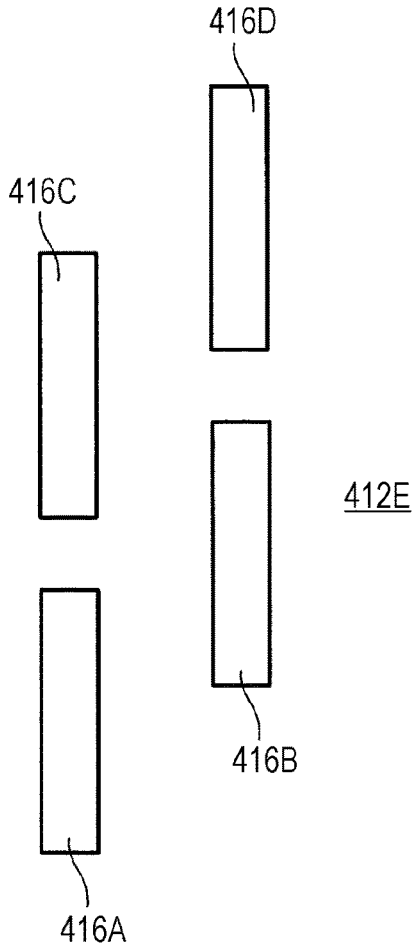
FIG. 14 is a view illustrating yet another example of the arrangement relationship of the developer detectors.

In the above-described embodiment, the respective positions in the longitudinal direction (illustrated left and right direction) of the developer detectors 416 are different from each other. However, the present invention is not limited thereto, and the respective positions in the longitudinal direction of the developer detectors 416 may be the same (see FIG. 13). In addition, as illustrated in FIG. 14, the positions in the longitudinal direction of the bottom developer detector 416A and the second developer detector 416C from the top may be the same, and the positions in the longitudinal direction of the second developer detector 416B from the bottom and the top developer detector 416D may be the same.

Figure 15:
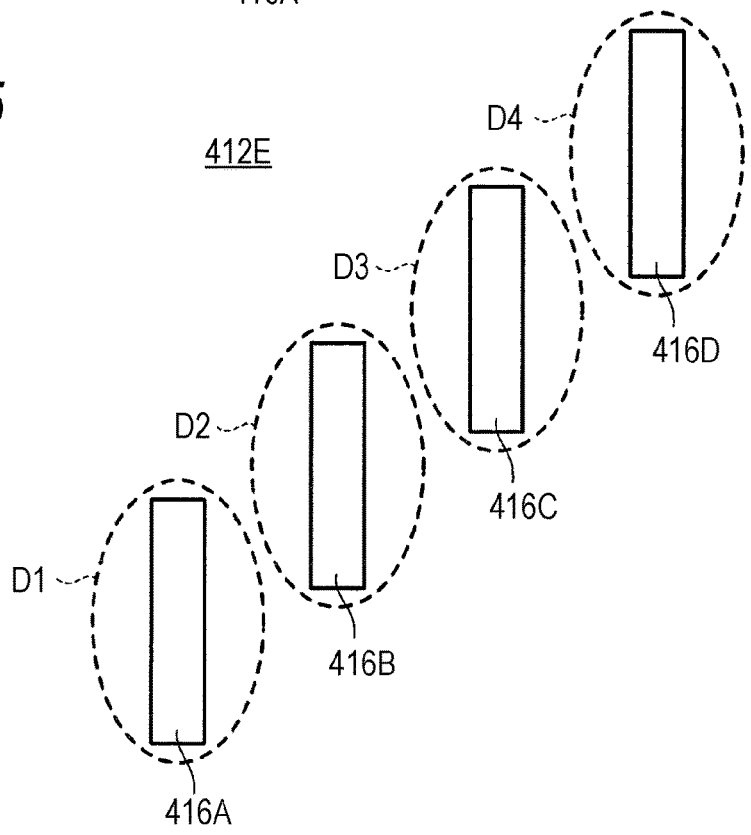
FIG. 15 is a view illustrating yet another example of the arrangement relationship of the developer detectors.

Furthermore, in the above-described embodiment, the developer detectors 416 are disposed having the region in which the two detection ranges adjacent to each other overlap; however, the present invention is not limited thereto. For example, as illustrated in FIG. 15, as long as the four developer detectors 416 each are disposed within the above-described predetermined range, the developer detectors 416 may be disposed not having a region in which the detection ranges overlap.

With this arrangement, the lines of magnetic force in the detection ranges do not interfere with each other and there is no influence of other detection ranges. Thus, the detection timings of the developer detectors 416 can be set at the same time.

Furthermore, in the above-described embodiment, each end in the longitudinal direction of the developer casing 412D has the plurality of the developer detectors 416; however, the present invention is not limited thereto. For example, as long as the developer detector can detect the plurality of detection ranges in the vertical direction by, for example, shifting the detection range in the vertical direction, only one developer detector may be included.

Figure 16:
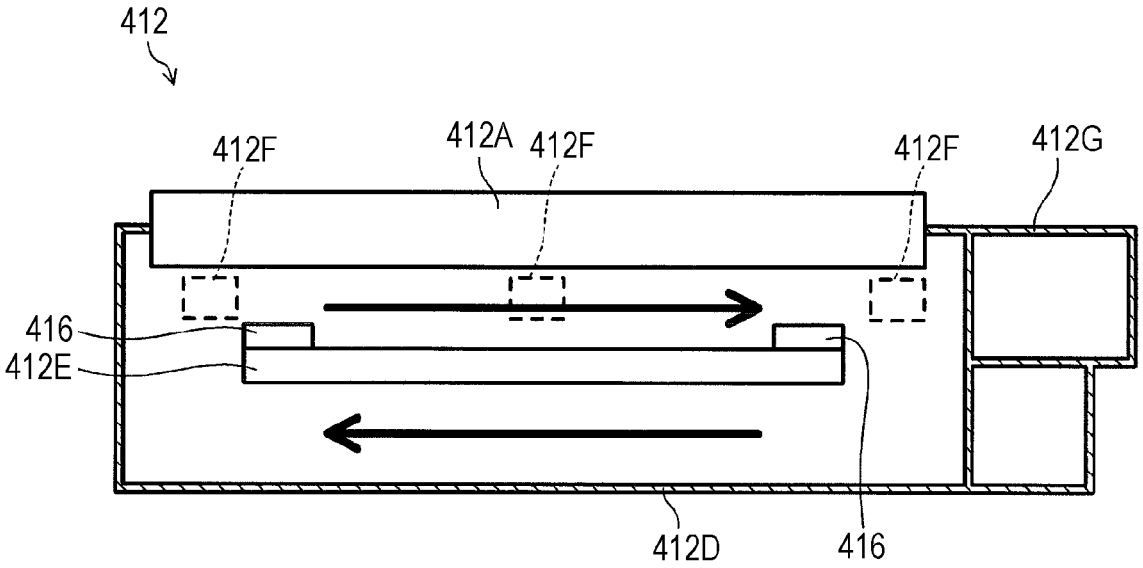
FIG. 16 is a view illustrating an example of a plurality of toner replenishers provided.

In the above embodiment, the control of changing the rotational speed of the stirring member has been exemplified as the control of correcting the inclination in the longitudinal direction of the liquid level of the developer. However, the present invention is not limited thereto. For example, as illustrated in FIG. 16, in a case where a plurality of toner replenishers 412F is provided at different positions in the longitudinal direction in the developer casing 412D, a toner replenisher 412F corresponding to the position where the amount of the developer is small in the longitudinal direction among the plurality of toner replenishers 412F may replenish toner to the developer casing 412D.

Furthermore, the above-described embodiment is a merely specified example for implementing the present invention, and the technical scope of the present invention should not be limitedly interpreted by the embodiment. That is, the present invention can be implemented in various forms without departing from the gist or the main features thereof.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein the hardware processor:

determines, based on a difference value between output values of the developer detector in two detection ranges adjacent to each other in the vertical direction, among the plurality of detection ranges, whether or not a first output value in an upper detection range of the two detection ranges is to be used for detecting the liquid level position of the developer; and detects, in a case where determining that the first output value is to be used for detecting the liquid level position of the developer, the liquid level position of the developer with the first output value.

2. The image forming apparatus according to claim 1, wherein the hardware processor:

detects toner concentration in the developer with a second output value of the developer detector in a detection range positioned below the detection range corresponding to the first output value; and corrects a detected value of the liquid level position of the developer based on the first output value, in accordance with the detected toner concentration.

3. The image forming apparatus according to claim 2, wherein the detection range corresponding to the second output value is positioned one level below the detection range corresponding to the first output value.

4. The image forming apparatus according to claim 1, wherein a plurality of the developer detectors is disposed side by side in the vertical direction in the developer casing.

5. An image forming apparatus comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein both ends in a longitudinal direction of the developer casing, each are provided with the developer detector, and the hardware processor:

detects the liquid level position of the developer from each of the developer detectors at both of the ends; and performs control of correcting inclination in the longitudinal direction of each of the liquid levels of the developer, in accordance with a difference value between the detected liquid level positions of the developer.

6. The image forming apparatus according to claim 5, further comprising:

a conveyance member that conveys the developer in the longitudinal direction in the developer casing, wherein the hardware processor changes a conveying speed of the conveyance member for the developer, in accordance with the difference value between the liquid level position of the developer on a first side and the liquid level position of the developer on a second side.

7. The image forming apparatus according to claim 5, further comprising:

a plurality of toner replenishers disposed at different positions in the longitudinal direction in the developer casing, wherein in accordance with the difference value between the liquid level position of the developer on a first side and the liquid level position of the developer on a second side, the hardware processor controls such that a toner replenisher corresponding to a position where an amount of the developer in the longitudinal direction is small among the plurality of toner replenishers, replenishes toner to the developer casing.

8. The image forming apparatus according to claim 1, wherein the two detection ranges adjacent to each other in the vertical direction among the plurality of detection ranges have a mutually overlapping region.

9. The image forming apparatus according to claim 8, further comprising:

a switcher capable of switching a detection range for detecting the developer among the plurality of detection ranges, wherein the hardware processor controls the switcher such that the developer detector does not simultaneously detect the two detection ranges adjacent to each other.

10. An image forming apparatus comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein the plurality of detection ranges is shifted in position in a horizontal direction, the plurality of detection ranges not overlapping mutually.

11. An image forming apparatus comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein the hardware processor determines either an excessive state of toner concentration or an insufficient state of an amount of the developer, in accordance with an output value of the developer detector corresponding to a detection range at a bottom position among the plurality of detection ranges.

12. The image forming apparatus according to claim 11, wherein the hardware processor:

increases an input voltage of the developer detector, in a case where the output value corresponding to the detection range at the bottom position is a predetermined threshold or less;

determines, in a case where the output value of the developer detector has increased in accordance with the increase in the input voltage, the excessive state of the toner concentration and performs control of recovering the toner concentration; and determines, in a case where the output value of the developer detector has not increased in accordance with the increase in the input voltage, the insufficient state of the amount of the developer and performs control of replenishing the toner.

13. The image forming apparatus according to claim 12, wherein the hardware processor performs control of outputting an alarm, in a case where the output value is the predetermined threshold or less although the control of recovering the toner concentration or the control of replenishing the toner has been performed a predetermined number of times or more.

14. An image forming apparatus comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein a detection range at a top position among the plurality of detection ranges includes a maximum position of the developer in the developer casing.

15. A developing device comprising:

a developer casing that accommodates a developer;

a developer detector that is disposed in the developer casing, and that detects, based on magnetic force, the developer from a plurality of detection ranges that is close to each other and is disposed side by side in a vertical direction in the developer casing; and a hardware processor that performs control of detecting a liquid level position of the developer in the developer casing, based on a detection result detected by the developer detector, wherein the hardware processor:

determines, based on a difference value between output values of the developer detector in two detection ranges adjacent to each other in the vertical direction, among the plurality of detection ranges, whether or not a first output value in an upper detection range of the two detection ranges is to be used for detecting the liquid level position of the developer; and detects, in a case where determining that the first output value is to be used for detecting the liquid level position of the developer, the liquid level position of the developer with the first output value.

16. A non-transitory recording medium storing a computer readable developer liquid-level detection program for an image forming apparatus having a developer casing that accommodates a developer, the computer readable developer liquid-level detection program causing a computer to perform:

detecting, based on magnetic force, the developer in the developer casing, from a plurality of detection ranges that is close to each other and is disposed side by side in a vertical direction in the developer casing;

performing control of detecting a liquid level position of the developer in the developer casing, based on a detection result detected by the detecting;

determining, based on a difference value between output values of the developer detector in two detection ranges adjacent to each other in the vertical direction, among the plurality of detection ranges, whether or not a first output value in an upper detection range of the two detection ranges is to be used for detecting the liquid level position of the developer; and detecting, in a case where determining that the first output value is to be used for detecting the liquid level position of the developer, the liquid level position of the developer with the first output value.

* * * * *